US005149028A

United States Patent [19]

Blackaby et al.

[11] Patent Number: 5,149,028

[45] Date of Patent: Sep. 22, 1992

[54] LAWN BAG SUPPORT FRAME

[76] Inventors: Colin T. Blackaby; Yvonne M. Blackaby, both of 3021 Perrysburg Rd., Logansport, Ind. 46947

[21] Appl. No.: 755,615

[22] Filed: Sep. 5, 1991

[51] Int. Cl.[5] ..... B65B 67/04

[52] U.S. Cl. ..... 248/101; 15/257.1; 294/1.1

[58] Field of Search ..... 248/95, 97, 99, 100, 248/101, 311.2; 220/404; 15/257.1, 257.4; 141/390; 294/1.1, 55; 53/390

[56] References Cited

U.S. PATENT DOCUMENTS

| | | | |
|---|---|---|---|
| 3,697,030 | 10/1972 | Schultz | 15/257.1 |
| 3,747,653 | 7/1973 | Ringer | 150/1 |
| 3,998,415 | 12/1976 | D'Antonio et al. | 248/101 |
| 4,023,842 | 5/1977 | Harvey | 294/1 R |
| 4,238,868 | 12/1980 | Sternberg | 15/257.4 |
| 4,304,379 | 12/1981 | Christensen | 248/101 |
| 4,318,521 | 3/1982 | Martin et al. | 248/99 |
| 4,358,083 | 11/1982 | Haubrich | 248/545 |
| 4,411,300 | 10/1983 | Rico | 150/51 |
| 4,548,372 | 10/1985 | Lutzker | 248/99 |
| 4,615,743 | 10/1986 | Bylenga | 134/6 |
| 4,664,348 | 5/1987 | Corsaut, III et al. | 248/99 |
| 4,738,478 | 4/1988 | Bean | 294/55 |
| 4,759,518 | 7/1988 | Yardas | 248/97 |
| 4,787,753 | 11/1988 | Barnhart | 383/33 |
| 4,805,858 | 2/1989 | Taylor | 248/99 |
| 4,951,903 | 8/1990 | Frey | 245/95 |
| 4,998,695 | 3/1991 | Nobis | 248/311.2 |
| 5,009,378 | 4/1991 | Linsmeyer et al. | 248/99 |
| 5,011,103 | 4/1991 | Hayes et al. | 248/99 |
| 5,031,948 | 7/1991 | Groth | 294/1.1 |

*Primary Examiner*—J. Franklin Foss
*Attorney, Agent, or Firm*—Woodard, Emhardt, Naughton, Moriarty & McNett

[57] ABSTRACT

A support frame is provided for supporting a lawn bag on the gound with its mouth open to receive leaves raked into the bag. The frame components include a flexible clip member having a longitudinal slot defined in one face of the clip. A flexible rod is adapted for press-fit engagement within the longitudinal slot of the flexible clip with a portion of the perimeter of a lawn bag trapped between the clip and the rod. The flexible rod has a length greater than the length of the flexible clip so that a portion of the rod overhangs from each end of the flexible clip. These overhang portions of the flexible rod are adapted to be pushed into the ground to support the frame, as well as the lawn bag. The clip and rod are sufficiently flexible to be bent into a U-shape while maintaining the mouth of the trash lawn bag open. In another aspect of the invention, a support block is provided which allows the support frame to be mounted to a vertical wall to support the plastic bag in a vertical orientation.

9 Claims, 1 Drawing Sheet

LAWN BAG SUPPORT FRAME

BACKGROUND OF THE INVENTION

This invention relates to a frame for supporting a lawn bag or trash bag. In particular, the invention concerns a frame for maintaining the mouth of the bag open to facilitate collecting leaves and lawn debris, for example.

Large plastic bags, such as lawn bags or trash bags, are widely used for collecting and discarding leaves, grass trimmings, and other lawn debris. However, since these bags are extremely pliable, it is often difficult for a single person to hold the mouth of the bag open and to rake leaves or debris into the bag or fill it in some other manner.

Some attempts have been made to provide frames for temporarily supporting the bag with the mouth open. In some such attempts, the bag is vertically supported, such as shown in the patent to Haubrich, U.S. Pat. No. 4,358,083. One difficulty with this approach is that the leaves, grass trimmings or lawn debris must be lifted from the ground into the bag opening.

In another approach, a framework is provided which permits the bag to rest on the ground for directly loading leaves into the mouth of the bag. For example, the patent to Ringer, U.S. Pat. No. 3,747,653, shows a generally triangular frame which is engaged within the mouth of the bag. However, the Ringer device does not include any means for fixing the bag or frame on the ground but instead relies on a handle which can be held by a person while the debris is being raked into the bag. Other patents show a construction which incorporate means for staking the frame to the ground. For instance, the patents to D'Antonio et al., U.S. Pat. No. 3,998,415 and Hayes et al., U.S. Pat. No. 5,011,103, show a framework that includes a ground-engaging bar with openings for inserting a peg or stake to secure the bar to the ground. The patent to Martin et al., U.S. Pat. No. 4,318,521, shows another framework in which spikes which are normally concealed within the framework are extendable to engage the ground. However, each of these ground-engaging devices require a fairly complicated multiple-piece framework.

There remains a need for a simple framework construction for supporting a lawn bag with the bag mouth open. The framework must have means for fixing the bag to the ground to permit "hands-off" filling of the bag.

SUMMARY OF THE INVENTION

In view of the deficiencies of prior devices and the need remaining in the art, a support frame is provided which includes a flexible clip member having a longitudinal slot defined in one face of the clip. A flexible rod is adapted to be engaged within the longitudinal slot of the flexible lip with a portion of the perimeter of a lawn bag trapped between the clip and the rod. The flexible rod has a length greater than the length of the flexible clip so that a portion of the rod overhangs from each end of the flexible clip. These overhang portions of the flexible rod are adapted to be pushed into the ground to support the frame, as well as the lawn bag. The clip and rod are sufficiently flexible to be bent into a U-shape while exerting enough radially outward force to maintain the mouth of the trash lawn bag open without tearing the bag.

In another aspect of the invention, a support block is provided which allows the frame to be mounted to vertically support the plastic bag. The support block includes means for mounting the block to a vertical surface, such as a wall. The block also includes an angled bore which is adapted to receive an end of the flexible rod of the support frame. Two such blocks are provided to support both overhung portions of the flexible rod so that the bag engaged between the clip and the rod hangs vertically beneath the frame.

It is one object of the invention to provide a frame for supporting a flexible bag with its mouth open. It is another object to provide such a frame which permits the bag to be filled while resting on the ground. A further object of the invention resides in a frame that is simple to assemble and that does not require a multitude of pieces.

Other objects and certain advantages of the invention will become apparent from the following disclosure and accompanying figures.

DESCRIPTION OF THE PREFERRED EMBODIMENTS

Figure 1:
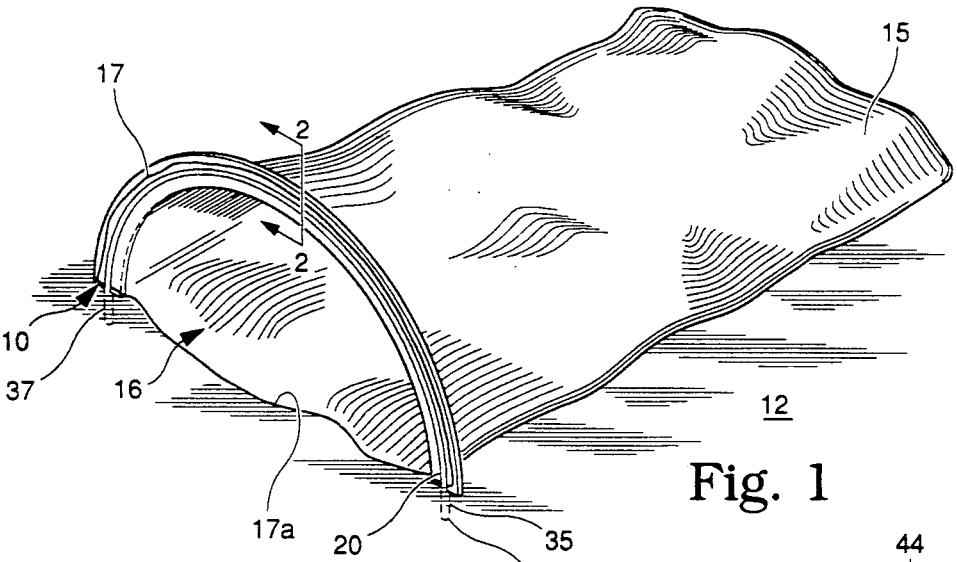
FIG. 1 is a perspective view of one embodiment of the invention in its operative position.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

According to a preferred embodiment of the invention, a support frame 10 is adapted for engagement with the ground 12 to support a lawn or trash bag 15. The lawn bag 15 can be of the flexible plastic type and includes a mouth or bag opening 16 having an upper edge or perimeter 17.

The support frame 10 includes two principal components—a flexible clip member 20 and a flexible rod member 35. As shown more particularly in FIG. 2, the flexible clip 20 includes a top face 22 into which is formed a longitudinal slot 24. The longitudinal slot 24 extends along the entire length of the flexible clip 20. The slot 24 includes a circular channel portion 26, or rod-receiving portion, and a relief portion 28 at the interior of the clip. Between the top face 22 and the channel portion 26 is a ridge 30 formed on either side of the longitudinal slot 24.

Figure 2:
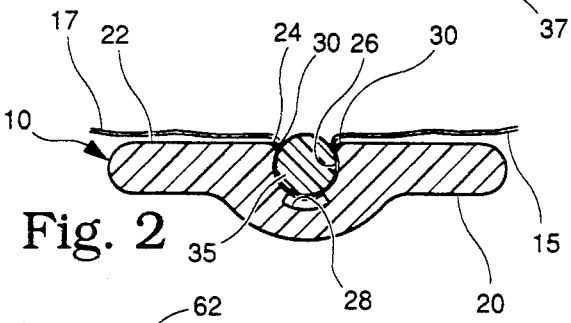
FIG. 2 is a detail cross-sectional view of the support frame shown in FIG. 1 taken along line 2—2 as viewed in the direction of the arrows.

The second principal component of the support frame 10 is the flexible rod 35. As shown in FIG. 2, the flexible rod 35 has a diameter that substantially matches the diameter of the circular channel portion 26 of the slot 24 in the flexible clip 20. The rod 35 has a length greater than the length of the flexible clip 20 so that the rod overhangs the clip 20, as shown in FIG. 1. The overhang portions 37 of the rod 35 are adapted to be pushed into the ground 12 to support the frame 10 relative to the ground.

To assemble the support frame 10, all that is required is that the flexible clip 20 be bent into a substantial U-shape, as shown in FIG .1, within the mouth 16 of the lawn bag 15, preferably adjacent the upper edge 17. The flexible rod 35 is then likewise bent into a U-shape and pressed into the longitudinal slot 24 of the plate 20 with the lawn bag 15 compressed between the clip and the rod. The relief portion 28 of the longitudinal slot 24 provides clearance for excess bag material to reside so that the lawn bag 15 is not inordinantly stretched when the rod 35 is assembled within the clip 20. The press-fit engagement between the clip member 20 and the rod member 35 is sufficiently strong to clamp and hold the bag material therebetween.

The rod 35 is engaged within the slot 24 so that the overhang portions 37 extend generally evenly beyond the ends of the clip 20. These overhang portions 37 are then pushed into the ground to hold the support frame 10 in place while being used. Thus, the mouth 16 of the lawn bag 16 is held open in a relatively stable position so that leaves or other lawn debris can be swept or raked into the bag. The overhang portions 37 also provide a ready grip to pull the rod 35 out of the slot 24 to permit removal of the bag 15.

The clip 20 and rod 35 must be sufficiently flexible to be able to assume the U-shape shown in FIG. 1. Likewise, the elasticity of the clip and rod cannot be so great that the radially outward force exerted by the bent frame components tear or deform the lawn bag 15 when engaged with the bag. The flexibility and elasticity of the frame components are calibrated by the material properties and the component dimensions. In the preferred embodiment, the flexible clip 20 and rod 35 are composed of a thermoplastic material. In one specific embodiment, the clip 20 has a length of 36 inches and a width across the top face 22 of about one inch. The thickness of the clip 20 is in this specific embodiment is ⅛".

The flexible rod in this specific embodiment has a length of 42", which is 6 inches longer than the flexible clip 20. This length of rod allows for the overhang portions 37 to extend three inches into the ground when the support frame is being used. The diameter of the rod 35 is approximately 5/16". Accordingly, the diameter of the circular channel portion 26 of the slot 24 in the clip 20 is also 5/16". Since the clip 20 is formed of a flexible material, the slot 24 will open slightly as the rod 35 is pushed past the ridges 30 until the rod is seated in the circular channel portion 26 of the slot. Sufficient resilience in the clip 20 facilitates assembly of the frame 10 since the clip can help hold the bag mouth 17 open while the rod 35 is pressed into the slot 24. However, if the rod is sufficiently resilient to support the assembled frame 10 and bag 15, the clip 20 can be made somewhat more flexible.

It is understood that the specific dimensions may vary according to the particular size and type of lawn bag being used. For instance, the 36" length of the flexible clip is sized to accommodate the length of the perimeter of a typical lawn bag mouth opening. As shown in FIG. 1, the clip 20 does not engage the entire upper edge 17 of the lawn bag 15. Instead, a minor portion 17*a* of the upper edge 17 is not engaged between the flexible clip 20 and rod 35. This portion rests against the ground but is maintained in a certain amount of tension by the outward force exerted by the frame 20. For example, a typical lawn bag 15 may have an upper edge perimetrical length of 54", which would accommodate the 36" length of the flexible clip 20 with about 18" of unsupported minor portion 17*a*.

Other variations of the described specific embodiment can be made to accommodate different lawn bag thicknesses. In the specific embodiment shown, it is assumed that a standard lawn bag is being utilized having a very nominal thickness. However, if a cloth type lawn bag or other bag having a greater thickness is used, the relative dimensions of the rod 35 and the circular portion 26 of the slot 24 must be adjusted accordingly to account for the additional bag thickness trapped between the frame components.

Figure 3:
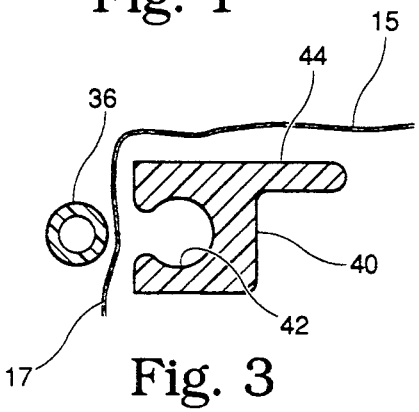
FIG. 3 is a detail cross-sectional view of an alternative embodiment of the support frame prior to being assembled with the trash bag supported by the frame.

In the preferred method of assembling the frame 10 as shown in FIG. 2, the flexible clip 20 is bent into the U-shape with the slot 24 facing radially outward. In this configuration, the lawn bag 15 is trapped against the top face 22 of the clip 20. In an alternative embodiment, a clip 40 shown in FIG. 3 includes a slot 42 that faces forward or generally parallel to the bag opening 16. The clip 40 can include a slot 42 adapted for press-fit engagement with the same flexible rod 35 of the previous embodiment or a flexible tube 36 of similar outer dimensions. The clip 40 can also include an extension portion 44 which provides further support for the upper edge 17 around the bag opening 16. The clip 40 of this embodiment requires that the upper edge 17 of the bag 15 be folded over the clip 40, which adds additional security against the bag pulling out of the frame 10, but also adds a slightly greater degree of difficulty to assembling the frame.

Figure 4:
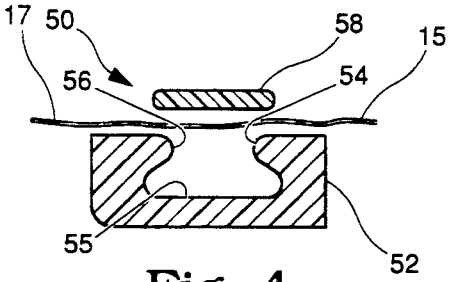
FIG. 4 is a detail cross-sectional view of another embodiment of the support frame prior to being assembled with the trash bag supported by the frame.

In another embodiment, a support frame 50 includes a clip 52 and a flexible strip 58 as shown in FIG. 4. The clip 52 includes a slot 54 which is configured into an interior channel portion 55 with ridges 56 formed at the top face of the slot. The flexible strip 58 is generally rectangular in configuration to fit within the channel portion 55 of the slot 54. This support frame 50 can be formed using less material than the prior embodiments, while providing the same degree of support to the lawn bag 15. However, the use of the strip 58 may add some greater degree of difficulty to pushing the overhang portions of the strip into the ground. Alternatively, the ends of the flexible strip 58 can be tapered into a spike or arrow configuration to facilitate pushing the strip ends into the ground. The same modification can be made to the ends of the flexible rod 35 of the previous embodiment, although rod 35 can be readily inserted into the ground without any end taper.

While the clips 20 and 52 of the embodiments shown in FIGS. 2 and 4 are depicted as oriented with the slots opening radially outward, the clips can be inverted with their respective slots opening radially inward. With this orientation, the support frame can be assembled by first disposing the flexible rod 35 or strip 58 substantially within the lawn bag 15. The clips 20 or 52, respectivley, can then be pressed around the corresponding rod or strip around the upper edge 17 of the lawn bag 15. In this configuration, the flexible clip 20 can have a length greater than the length of the flexible rod 35 so that the clip 20 or 52 can be pressed into the ground 12.

Figure 5:
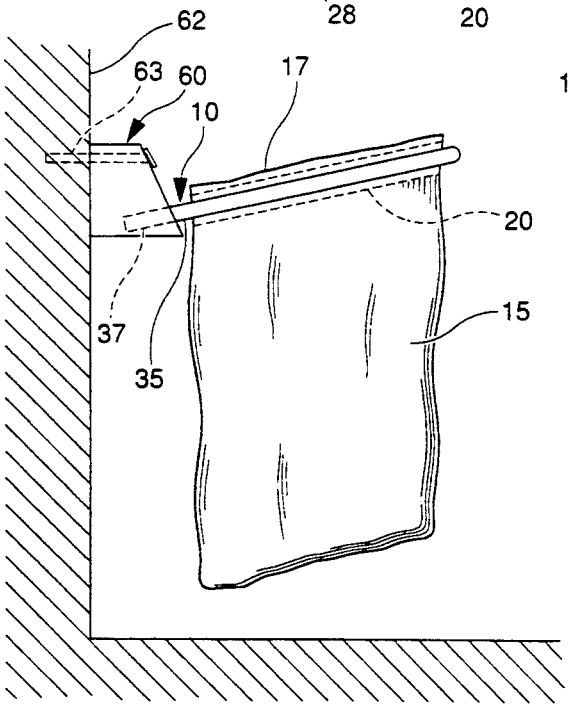
FIG. 5 is a side elevational view of another feature of the invention in which a support block is used to mount the support frame to a vertical surface.
Figure 6:
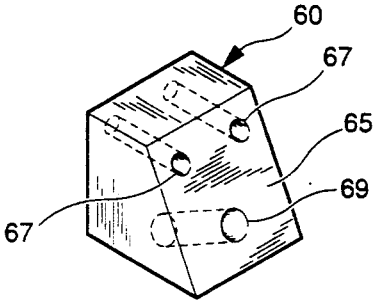
FIG. 6 is a perspective view of the support block shown in FIG. 5.

In another aspect of the invention, a wall-mounted support block 60 is provided as shown in FIG. 5, which is adapted to mate with the support frame 10 previously described. The support block 60 is adapted to engage a vertical surface, such as a wall 62, by way of mounting screws 63. As shown in more detail in FIG. 6, the support block 60 includes an outer face 65 through which is defined a pair of screw bores 67. A rod bore 69 is also defined in the outer face 65. The rod bore 69 is preferably at an angle to the horizontal or to the wall 62 so that the support frame 10 can be held in its operative position by gravity and without the need of additional fasteners.

In use, two such support blocks 60 are mounted to the wall 62 by way of mounting screws 63 passing through the screw bores 67. The supporting blocks 60 can be disposed about 18" apart to accommodate the standard lawn bag 15. The support frame 10, and particularly the overhang portions 37 of the flexible rod 35, can then be inserted into the corresponding rod bores 69 so that the frame 10 is supported in a cantilever configuration. The lawn bag 15 can then be held between the components of the frame 10. Alternatively, the lawn bag can already be supported by the frame when the overhang portions 37 of the rod 35 are mounted within the rod bores 69. The support block 60 thus provides ready means for adapting the support frame 10 for use in vertically supporting the lawn bag 15.

Each of the components of the support frames 10 or 50 can be composed of a thermoplastic material. The flexible rod 35 can be a solid rod or a tube, depending upon the amount of flexibility required and the diameter of rod. Each of the components of the support frame of the present invention can be readily manufactured in well-known extrusion processes. The dimensions of the support frame components can be easily modified to accommodate different size bags. In addition, greater lengths of flexible rod 35 can be provided so that longer overhang portions 37 are available as required to firmly support the frame 20 with the lawn bag 15 engaged. It had been found, however, that three inches of overhang at either end of the flexible clip 20 is sufficient to hold the frame 10 in place on the ground 12 without having it fall over as leaves or grass are being raked into the open mouth 16 of the lawn bag 15.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to the protected.

What is claimed is:

1. A support assembly for use in combination wit a flexible container for supporting the container with the mouth of the container open, comprising:

an elongated clip having a longitudinal length substantially less than the length of the perimeter of the mouth of the flexible container, the clip having a slot formed therein along the entire longitudinal length of the clip, said clip being sufficiently flexible to assume an arcuate shape when disposed entirely within the container adjacent the mouth of the container, said clip being formed of a resilient material to exert a radially outward force against the container when the clip is disposed entirely therein to hold the mouth of the container open; and an elongated flexible and resilient rod having an outer surface configured for press-fit engagement within said slot of said clip with a portion of the container trapped therebetween, and means integral with said rod for engaging the ground, wherein said rod has a longitudinal length greater than the longitudinal length of said clip to define overhang portions at the ends of said rod extending beyond the ends of said clip during said press-fit engagement, said overhang portions having a length sufficient for engagement into the ground to maintain the support assembly in position on the ground.

2. The support assembly of claim 1, wherein:

said longitudinal slot includes a rod-receiving portion and a relief portion interior from said rod-receiving portion, said relief portion adapted to receive excess container material therein when the container is trapped between said clip and said rod.

3. The support assembly according to claim 1, wherein:

said slot includes a rod-receiving portion and ridge portions on opposite sides of said slot, said ridge portions defining a slot opening that is smaller than the outer dimension of said rod, wherein said rod-receiving portion has a dimension at least equal to the outer dimension of said rod.

4. The support assembly of claim 1 wherein said length of said rod member is at least six inches greater than said length of said clip member.

5. The support assembly of claim 1 wherein said flexible rod member has a solid circular cross-section.

6. The support assembly of claim 1 wherein said flexible rod member has a tubular cross-section.

7. The support assembly of claim 1 wherein said flexible rod member has a rectangular cross-section.

8. The support assembly of claim 1 further comprising:

support block means having means for engaging the support block with a vertical surface and having an outer face with a pair of bores formed therein, each said bores being configured to receive one of said overhang portions of said flexible rod therein;

wherein said pair of bores are angled upwardly relative to the vertical surface.

9. A support assembly for use in combination with a flexible container for supporting the container with the mouth of the container open, comprising:

a first elongated member for engaging entirely within the mouth of a container including means for resiliently urging the mouth open;

a second elongate member having integral means for piercing into the ground; and means between said first member and said second member for trapping at least a portion of the container therebetween with said second member entirely outside the mouth of the container.

* * * * *

UNITED STATES PATENT AND TRADEMARK OFFICE

CERTIFICATE OF CORRECTION

PATENT NO. : 5,149,028

DATED : September 22, 1992

INVENTOR(S) : Blackaby et al.

It is certified that error appears in the above-identified patent and that said Letters Patent is hereby corrected as shown below:

Column 5, line 57, the last word "the" should be changed to "be";

Column 5, line 60, "wit" should be changed to "with".

Signed and Sealed this

Twenty-eighth Day of September, 1993

Bruce Lehman

*Attest:*

BRUCE LEHMAN

*Attesting Officer*

*Commissioner of Patents and Trademarks*